United States Patent [19]

Vieland

[11] Patent Number: 4,514,663

[45] Date of Patent: Apr. 30, 1985

[54] ELECTRON BEAM INJECTION STRUCTURE FOR FLAT PANEL DISPLAY DEVICES

[75] Inventor: Leon J. Vieland, Princeton, N.J.

[73] Assignee: RCA Corporation, Princeton, N.J.

[21] Appl. No.: 489,800

[22] Filed: Apr. 29, 1983

[51] Int. Cl.[3] ..... H01J 29/70

[52] U.S. Cl. ..... 315/366; 313/422

[58] Field of Search ..... 313/422; 315/366

[56] References Cited

U.S. PATENT DOCUMENTS

| | | | |
|---|---|---|---|
| 4,128,784 | 12/1978 | Anderson | 313/422 |
| 4,234,815 | 11/1980 | Credelle | 313/422 |
| 4,263,529 | 4/1981 | Siekanowicz | 313/422 |
| 4,330,735 | 4/1982 | Leedom | 313/422 |

*Primary Examiner*—Palmer Demeo

*Attorney, Agent, or Firm*—E. M. Whitacre; D. H. Irlbeck; L. L. Hallacher

[57] ABSTRACT

An electron beam injection structure for flat panel display device includes electron injection electrodes which span a beam guide assembly for propagating electron beams. One end of the electron injection electrodes is in closer proximity to the cathode than the corresponding end of the beam guide structure. The injection of electrons from the cathode to the beam guide structure therefore can be maximized by increasing the voltage on the electron injection electrodes while permitting changes in the operating voltages applied to the beam guide structure and other elements of the display device.

4 Claims, 2 Drawing Figures

ELECTRON BEAM INJECTION STRUCTURE FOR FLAT PANEL DISPLAY DEVICES

BACKGROUND OF THE INVENTION

This invention relates generally to flat panel display devices and particularly to an electron beam injection structure for such devices.

Prior art flat panel display devices, such as those described in U.S. Pat. Nos. 4,234,815 and 4,263,529 include a baseplate and a faceplate which are held in a spaced parallel relationship by a plurality of external side walls. The envelope is divided into a plurality of channels by internal walls which also provide support against collapse due to atmospheric pressure. Each of the channels includes a guide mesh structure, such as that described in U.S. Pat. No. 4,330,735, to propagate electron beams the lengths of the channels until one line of the visual display is to be produced.

The beam guide assemblies include beam guide meshes, a focus mesh and an acceleration mesh all of which are arranged in a spaced parallel relationship. The electrons are emitted from a cathode which is arranged at the entrance to each guide mesh structure. The guide mesh structures are biased positive with respect to the cathode and thus control the injection of electrons to the guide mesh structure from the cathode. A plurality of extraction electrodes is arranged on the baseplate and a phosphor screen, which luminesces when struck by electrons, is arranged on the faceplate. The meshes of the beam guide assembly include apertures arranged in columns longitudinally along the meshes and when a three-beam system is used are arranged in rows transversely of the meshes. The guide mesh assemblies are disposed with the apertures in the guide meshes in alignment with the extraction electrodes. Electrons are propagated in the space between the guide meshes by biasing the focusing mesh and the extraction electrodes to focus the electrons into beams between the two guide meshes. When a line is to be produced on the screen, an appropriate extraction electrode is biased with a negative voltage to repel the electrons through the apertures to propagate toward the screen. The acceleration mesh is positively biased to attract the electrons toward the screen. Flat panel display devices built in accordance with the prior art operate satisfactorily for the purposes intended. In the prior art devices the beam guide meshes between which the electron beams propagate are biased positive with respect to the cathodes. This positive voltage on the beam guide meshes causes the electrons emanating from the cathodes to be injected into the space between the guide meshes. The efficiency; that is, maximum electron beam current and minimum electron leakage, of electron injection into the beam guide meshes can be enhanced by changing the positive voltage on the guide meshes. Electron leakage results in stray electrons randomly reaching the screen and lowering the contrast of the visual display. Enhancement of the efficiency of electron injection into the beam guides is desirable because the lower electron leakage improves the contrast of the visual display. However, changing the guide mesh voltage results in the requirement that other operating parameters, such as the focus voltage and the anode voltage, also are changed. Typically the other operating parameters are selected to optimize other characteristics, such as electron spot size, of the display device. For this reason, it is highly undesirable to change these parameters and, therefore, the efficiency of electron injection to the guide meshes cannot be optimized. It, therefore, would be advantageous to efficiently inject electrons from the cathode into the space between the guide mesh pairs independently of the other operating parameters of the display device.

The instant invention provides this advantage by the provision of an electron beam injection structure which maximizes the injection of electrons into the beam guide structure independently of the voltage on the beam guide meshes and of the other operating parameters of the display device.

SUMMARY OF THE INVENTION

A flat panel display device is divided into a plurality of channels each of which includes an electron gun section, and an electron beam guide section. The electron gun section includes cathode means for providing electron beams and means for modulating the electron beams. The electron guide section receives the electron beams and propagates the beams longitudinally along the guides. Electron injection means is arranged between the cathode and the electron guide section for injecting electrons to the guide section from the cathode. The electron injection means includes spaced substantially parallel injection electrodes, one end of which is arranged in the proximity of the cathode, and the other end of which is arranged on opposite sides of the guide section.

DETAILED DESCRIPTION OF THE PREFERRED EMBODIMEMT

Figure 1:
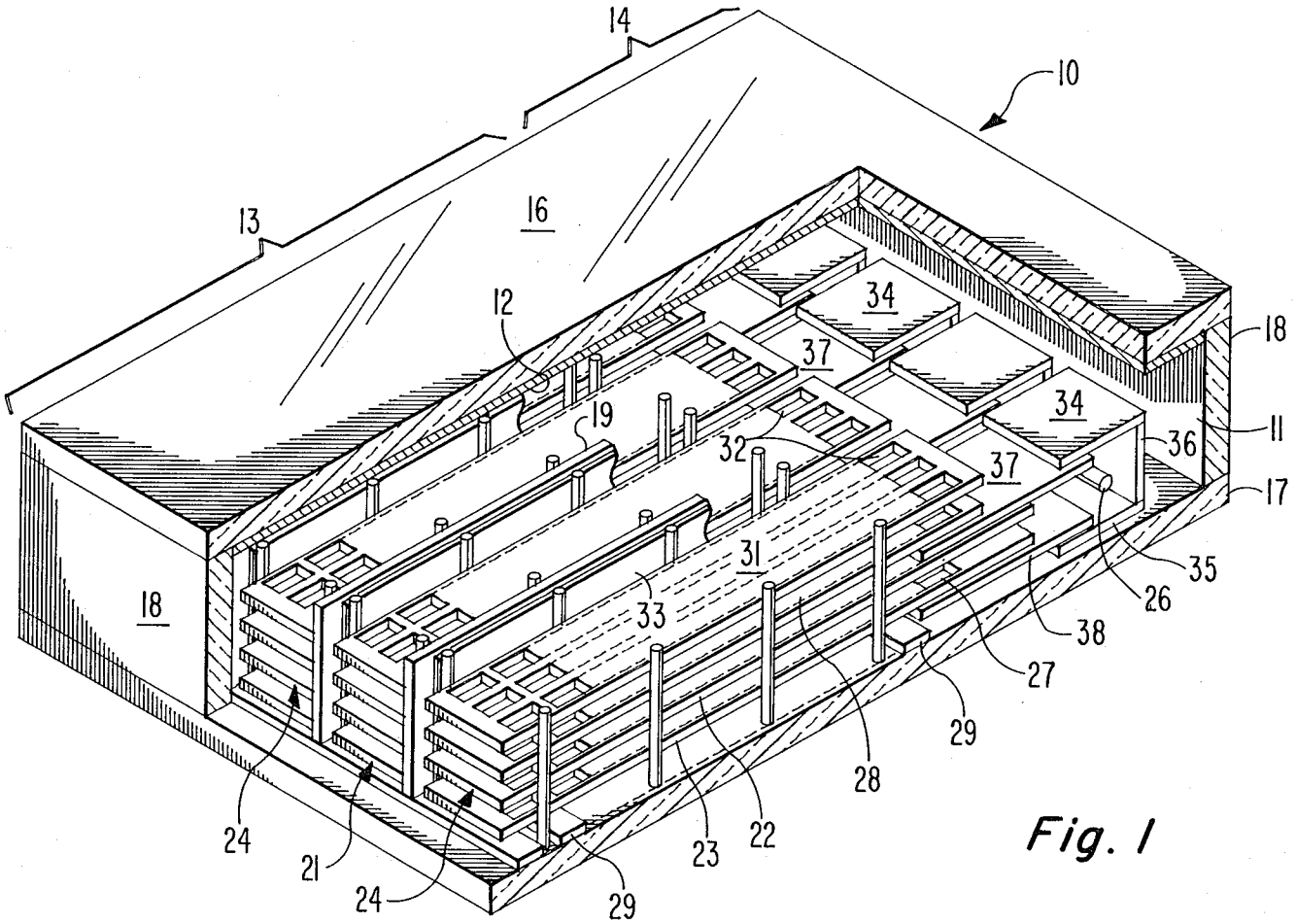
FIG. 1 is an isometric view, partially broken away, of a flat panel display device incorporating a preferred embodiment.
Figure 2:
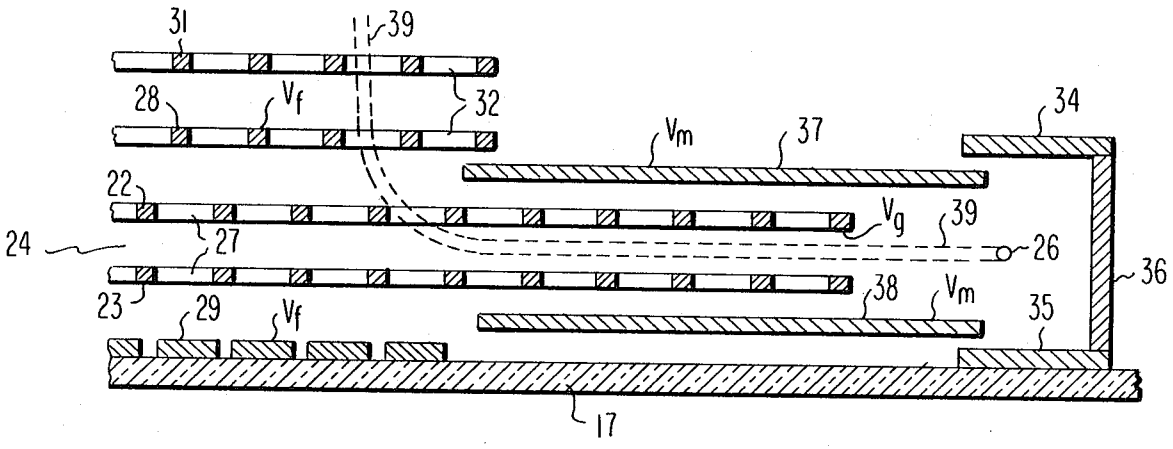
FIG. 2 is a cross-sectional view, partially broken away, of the preferred embodiment of FIG. 1.

FIGS. 1 and 2 show a flat panel display device 10 incorporating the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs of each channel. An individual cathode can be used for each electron beam of the device, a number of cathodes can be used to provide the electrons needed for several beams or a single line cathode can be used to produce the electrons for all the beams. The guide meshes 22 and 23 include apertures 27 which are arranged in columns longitudinally along the channels 21 and in rows transversely across the channels when three electron beams are used. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the apertures 27 in the guide meshes 22 and 23. Appropriate biasing voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 32 which also are aligned in columns longitudinally of the channels and, if needed, in rows transversely of the channels. Scanning electrodes 33 are arranged on both sides of the support vanes 19 so that each vane supports a scanning electrode for two adjacent channels.

The gun section 14 includes modulation electrodes 34 and 35 arranged on opposite sides of the cathode 26. The modulation electrodes 34 and 35 are electrically connected, such as by a conductive member 36, so that the same modulation voltage is applied to both the modulations electrodes. Electron injection electrodes 37 and 38 are arranged on opposite sides of, and substantially parallel to, the guide meshes 22 and 23. The proximal ends of the electron injection electrodes 37 and 38 are arranged in proximity of the cathode 26 and preferably are between the modulation electrodes 34 and 35. The distal end of the electron injection electrodes 37 and 38 are arranged on opposite sides of the guide meshes 22 and 23. The electron injection electrodes 37 and 38 can span one, or more, of the apertures 27 in each of the beam guide meshes 22 and 23. Alternatively, the injection electrodes 37 and 38 can be made shorter than shown in FIG. 2 and overlap the input end of the meshes 22 and 23 without overlapping any of the apertures 27.

In operation, the electron injection electrodes 37 and 38 are set at a positive injection voltage Vm, and the guide meshes 22 and 23 are set at a positive guide voltage Vg, which is less than the injection voltage Vm. The cathode 26 is in closer proximity to the electron injection electrodes 37 and 38 than to the guide meshes 22 and 23. Accordingly, the primary positive voltage which influences electrons emanating from the cathode is the injection voltage Vm on the electron injection electrodes 37 and 38. Additionally, when the injection electrodes 37 and 38 overlap one or more of the apertures 27 in the guide meshes 22 and 23, the positive voltage Vm on the electron injection electrodes 37 and 38 serves to focus the electrons emanating from the cathode into a beam 39 in the space 24 between the guide meshes 22 and 23. After the electron beam 39 propagates past the distal end of the electron injection electrodes 37 and 38, a positive focus voltage Vf on the focus mesh 28 and the extraction electrodes 29 continues to focus the beams between the guide meshes 22 and 23. The injection of electrons from the cathode 26 into the space 24 can be maximized by increasing the injection voltage Vm on the electron injection electrodes 37 and 38 independently of the guide voltage Vg on the guide meshes 22 and 23. Accordingly, the voltage on the guide meshes 22 and 23 can be changed without adversely affecting the injection of electrons into the space 24. The independence of electron injection and beam focusing permits the other operating parameters, such as the focus and screen voltages, to be optimized while simultaneously maintaining maximum electron injection to the beam guides. For example, a decrease in the guide voltage Vg permits a decrease in the voltage on the extraction electrodes 29 while maintaining optimum focusing of the electron beams 39 in the space 24. This lower voltage permits the extraction of the beams 39 from the space 24 with a less negative extraction voltage on the extraction electrode 29 than is required when a higher voltage is used on the beam guides. The instant invention, therefore, results in the maximization of electron injection into the beam guide assemblies while simultaneously permitting tube operation with a lower focusing voltage and a less negative extraction voltage. The differential voltage which must be switched when going from focussing to extraction, therefore, is substantially decreased. Additionally, the electron beam current can be optimized to increase the display brightness while maintaining the electron leakage at an acceptable low level. Also, the voltages on the acceleration mesh 31 and the screen 12 can be adjusted to optimize other operating characteristics, such as electron beam spot size, of the display device.

What is claimed is:

1. In a flat panel display device having a display screen and an evacuated envelope divided into a plurality of channels, said channels including an electron gun section, and an electron beam guide section, said electron gun section including cathode means for providing electrons and means for modulating said electrons, said electron guide section including spaced substantially parallel rectangular beam guides for receiving and focusing said electrons into beams in the space between said guides, said beam guides having a plurality of apertures arranged in columns longitudinally along said channels, an improvement comprising:

electron injection means arranged between said cathode means and said electron guide section for injecting electrons to said guide section from said cathode means; said electron injection means including spaced substantially parallel rectangular injection electrodes, one end of said injection electrodes being arranged in the proximity of said cathode, and the other end of said injection electrodes being arranged on opposite sides of said electron guide section whereby a portion of said electron guide section is between a portion of said injection electrodes.

2. The improvement of claim 1 wherein said means for modulating includes spaced substantially parallel modulation electrodes, said cathode means being arranged between said modulation electrodes, and wherein said one end of said injection electrodes is arranged between said modulation electrodes in the proximity of said cathode means.

3. The improvement of claim 1 wherein said beam guides are biased at a voltage Vg and said injection electrodes are set at a voltage Vm, and wherein $Vg < Vm$.

4. The improvement of claim 2 wherein said beam guides are biased at a voltage Vg and said injection electrodes are set at a voltage Vm, and wherein $Vg < Vm$.

* * * * *